United States Patent [19]

Eberhart

[11] Patent Number: 4,749,100

[45] Date of Patent: Jun. 7, 1988

[54] SANITARY LID FOR BEVERAGE CANS

[76] Inventor: Ray Eberhart, 417 E. Jefferson, Mishawaka, Ind. 46545

[21] Appl. No.: 902,621

[22] Filed: Sep. 2, 1986

[51] Int. Cl.[4] ..... B65D 41/16; B65D 41/18

[52] U.S. Cl. ..... 220/306; 220/258

[58] Field of Search ..... 220/90.2, 258, 256, 220/306

[56] References Cited

U.S. PATENT DOCUMENTS 3,204,805 9/1965 May ..... 220/258

3,362,572 1/1968 Pelley ..... 220/90.2

FOREIGN PATENT DOCUMENTS 1448247 9/1976 United Kingdom ..... 220/258

*Primary Examiner*—George T. Hall

*Attorney, Agent, or Firm*—Thomas J. Dodd

[57] ABSTRACT

A disposable lid which is detachably fastened to the upper marginal lip of a beverage can. The lid overlies the top wall of the can to prevent entry of dirt prior to use of the can.

3 Claims, 4 Drawing Sheets

SANITARY LID FOR BEVERAGE CANS

SUMMARY OF THE INVENTION

This invention relates to a disposable lid for beverage cans.

Canned beverages are very popular throughout the world. In recent years, manufacturers have modified such cans by providing them with upper marginal lips to facilitate stacking large numbers of cans. One of the major problems of such a construction is that dirt and other contaminants are easily caught and contained by the can top wall which requires that the can be washed prior to use. Sanitation problems may also occur.

The lid of this invention includes a continuous sheet of material and a peripheral snap interlock portion which is detachably fastened to the can. When so fastened, the lid seals the top wall of the can against entry of dirt, germs, and other contaminants.

Accordingly, it is an object of this invention to provide a removable lid which is for beverage cans.

Another object of this invention is to provide for a beverage can lid which effectively seals the can top wall against entry of dirt and germs.

Another object of this invention is to provide for a disposable can lid which is economical.

Other objects of this invention will become apparent upon a reading of the following description.

BRIEF DESCRIPTION OF THE DRAWINGS

A preferred embodiment of the invention has been depicted for illustrative purposes wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize the invention.

Figure 1:
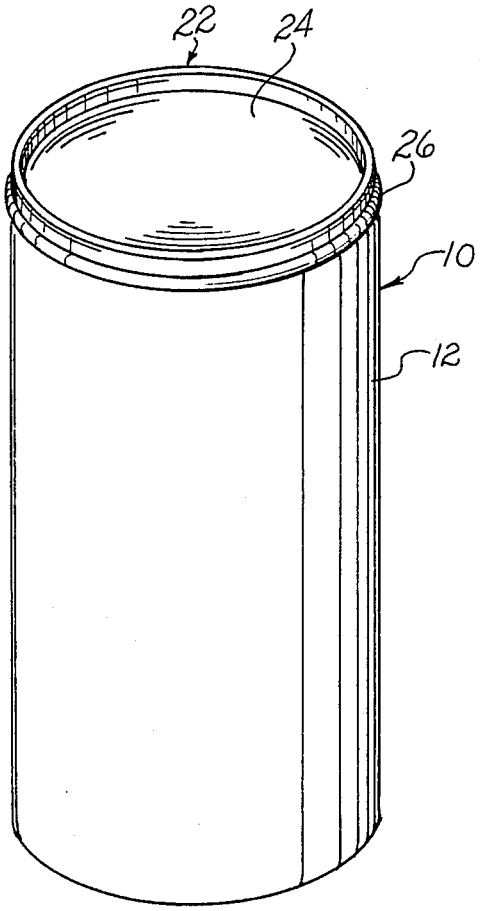
FIG. 1 is a perspective view of a beverage can with the disposable sanitary lid shown attached to the can.
Figure 2:
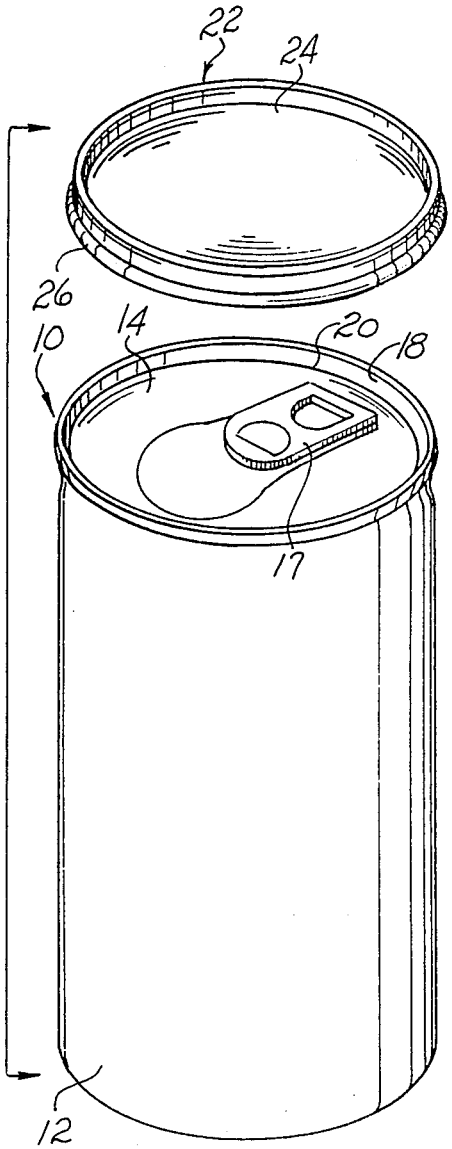
FIG. 2 is a perspective view of the beverage can and the lid shown in separated form.
Figure 3:
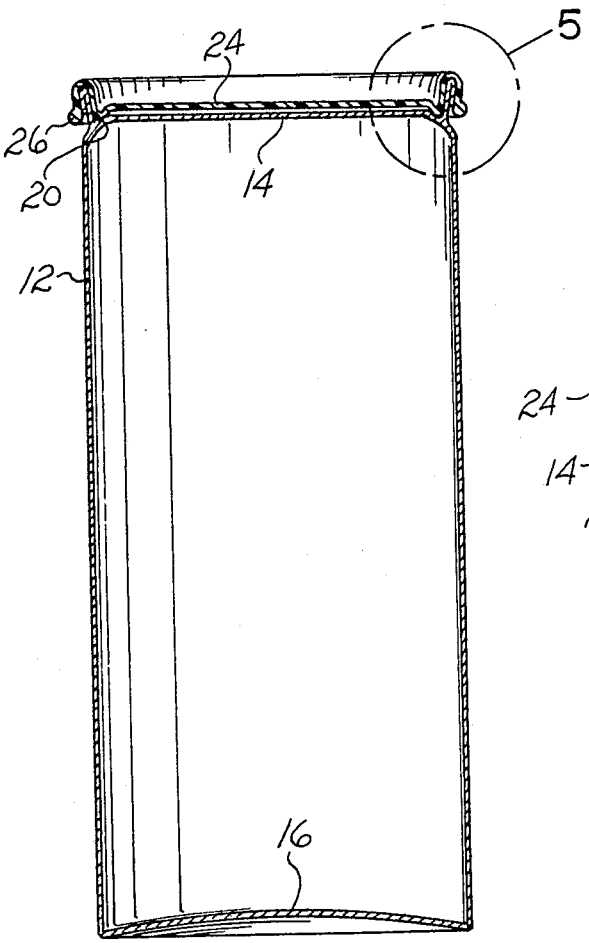
FIG. 3 is an elevational view of the can and attached lid with portions shown in section for purposes of illustration.
Figure 5:
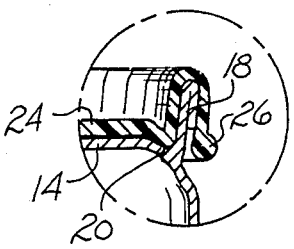
FIG. 5 is a detail view of the lid seen inside broken circle 5 of FIG. 3.

Referring to the drawings, reference numeral 10 designates a conventional beverage can which houses soft drinks, beer, fruit juices and other beverages prior to purchase by a consumer. Can 10 forms a complete enclosure for the beverage and is defined by a continuous side wall 12, top wall 14, and bottom wall 16. Top wall 14 and bottom wall 16 are formed as shown in FIG. 3 to allow stacking of multiple cans during shipment. Top wall 14 may also include a removable tab 17 to allow a purchaser to drink or pour beverage from the can. A lip 18 protrudes upwardly from can side wall 12 continuously about the peripheral edge of top wall 14 and forms a narrow channel 20 between the lip and the top wall. Because of this construction, dirt and bacteria often accumulate in channel 20 during shipment and prior to purchase by the consumer.

Figure 4:
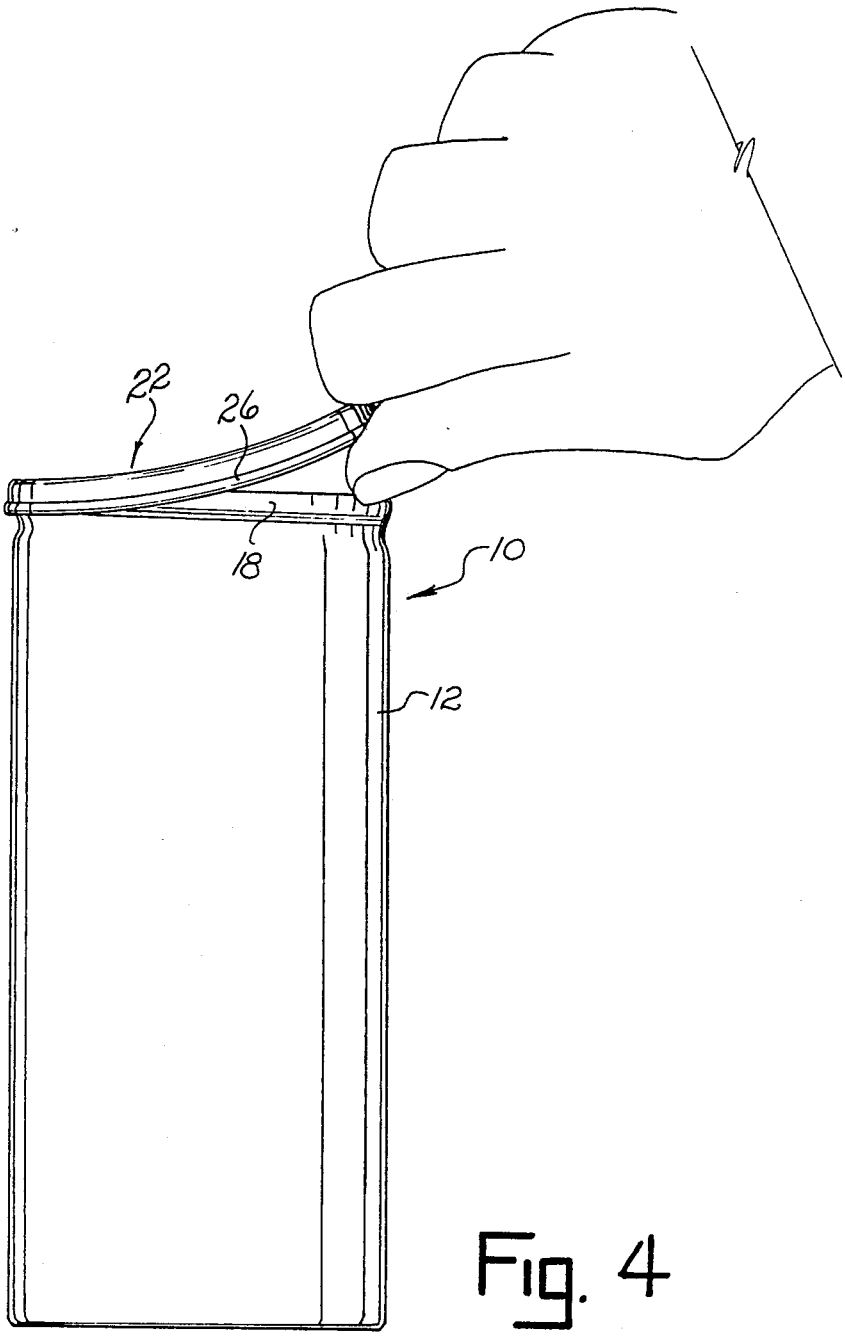
FIG. 4 is an elevational view of the can illustrating the lid removal procedure.
Figure 6:
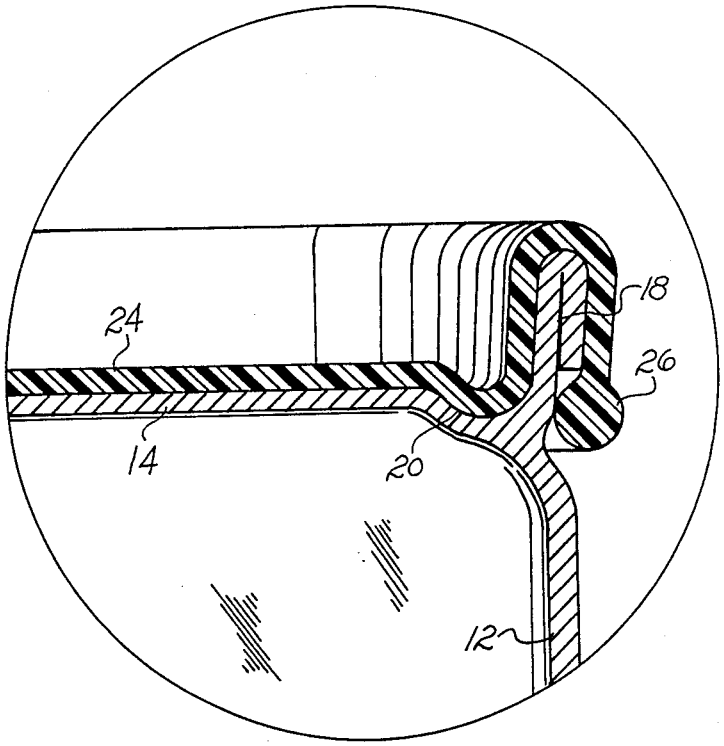
FIG. 6 is an enlarged detail view of the lid of FIG. 5.

Numeral 22 depicts the lid of this invention which includes a continuous sheet of material 24 and an integral flange 26 which is formed about the periphery of the lid. Flange 26 is shown as a bead in FIG. 3 and is snap fitted over can lip 18 to seal lid 22 to the can lip. When sealed, sheet 24 covers can top wall 14 and channel 20 to prevent entry of dirt and bacteria prior to purchase. To remove lid 22 after purchase, a user pulls upwardly on lid flange 26 as shown in FIG. 4. Lid 22 may be formed of any suitable material such as molded plastics, paper, or biodegradable materials such as treated paper, or other flexible materials.

It is understood that the above description does not limit the invention to those precise details, but may be modified within the scope of the following claims.

I claim:

1. In combination, a beverage can and a lid, said can including a continuous side wall and connecting top and bottom walls to form an enclosure, a continuous peripheral lip extending upwardly from said side wall about said can top wall, said lid including a continuous sheet of material completely overlying said can top wall, a marginal snap interlock flange integral with said continuous sheet for detachably fastening said lid to said can peripheral lip, said lip positioned in abutment with said can top wall and peripheral lip and constituting means for sealing said can top wall against entry of contaminants.

2. The combination of claim 1 wherein said lid is formed of biodegradable materials.

3. The combination of claim 1 wherein said lip flange terminates in a peripheral cylindrical bead in abutment with said can side wall.

* * * * *